US006065823A

United States Patent [19]

Kawamura

[11] Patent Number: 6,065,823

[45] Date of Patent: May 23, 2000

[54] HEAT SPREADER FOR INK-JET PRINTHEAD

[75] Inventor: Naoto A. Kawamura, Corvallis, Oreg.

[73] Assignee: Hewlett-Packard Company, Palo Alto, Calif.

[21] Appl. No.: 09/293,286

[22] Filed: Apr. 16, 1999

[51] Int. Cl.[7] ..... B41J 29/377

[52] U.S. Cl. ..... 347/18; 347/67; 347/17

[58] Field of Search ..... 347/56, 63, 65, 347/67, 18, 17

[56] References Cited

U.S. PATENT DOCUMENTS

| | | | |
|---|---|---|---|
| 4,723,129 | 2/1988 | Endo et al. | 347/56 |
| 4,894,664 | 1/1990 | Tsung | 347/63 |
| 5,066,964 | 11/1991 | Fukuda et al. | 347/18 |
| 5,084,713 | 1/1992 | Wong | 347/18 |
| 5,159,353 | 10/1992 | Fasen et al. | 347/59 |
| 5,272,491 | 12/1993 | Asakawa et al. | 347/18 |
| 5,459,498 | 10/1995 | Seccombe et al. | 347/18 |
| 5,657,061 | 8/1997 | Seccombe et al. | 347/18 |
| 5,665,249 | 9/1997 | Burke et al. | 216/2 |
| 5,710,070 | 1/1998 | Chan | 438/21 |
| 5,774,148 | 6/1998 | Cornell et al. | 347/59 |
| 5,783,474 | 7/1998 | Ajit | 438/279 |
| 5,841,452 | 11/1998 | Silverbrook | 347/47 |
| 5,850,241 | 12/1998 | Silverbrook | 347/54 |
| 5,900,894 | 5/1999 | Koizumi et al. | 347/65 |

*Primary Examiner*—John Barlow
*Assistant Examiner*—Juanita Stephens
*Attorney, Agent, or Firm*—Timothy F. Myers; Raymond A. Jenski

[57] ABSTRACT

A printhead for ejecting fluid has a nozzle on a first surface and a fluid feed channel defined within a second surface. The printhead includes an aggregate of thin-film layers, a portion of which is exposed by the fluid feed channel. The aggregate of thin-film layers contains at least one energy dissipation element suspended over the fluid feed channel. A heat spreader is mesially interposed within the aggregate of thin-film layers. The heat spreader proximally abuts to the energy dissipation element and extends from the energy dissipation element to extend past the fluid feed channel definition. The heat spreader is capable of dissipating heat from the energy dissipation element to a portion of the first surface of the printhead.

29 Claims, 9 Drawing Sheets

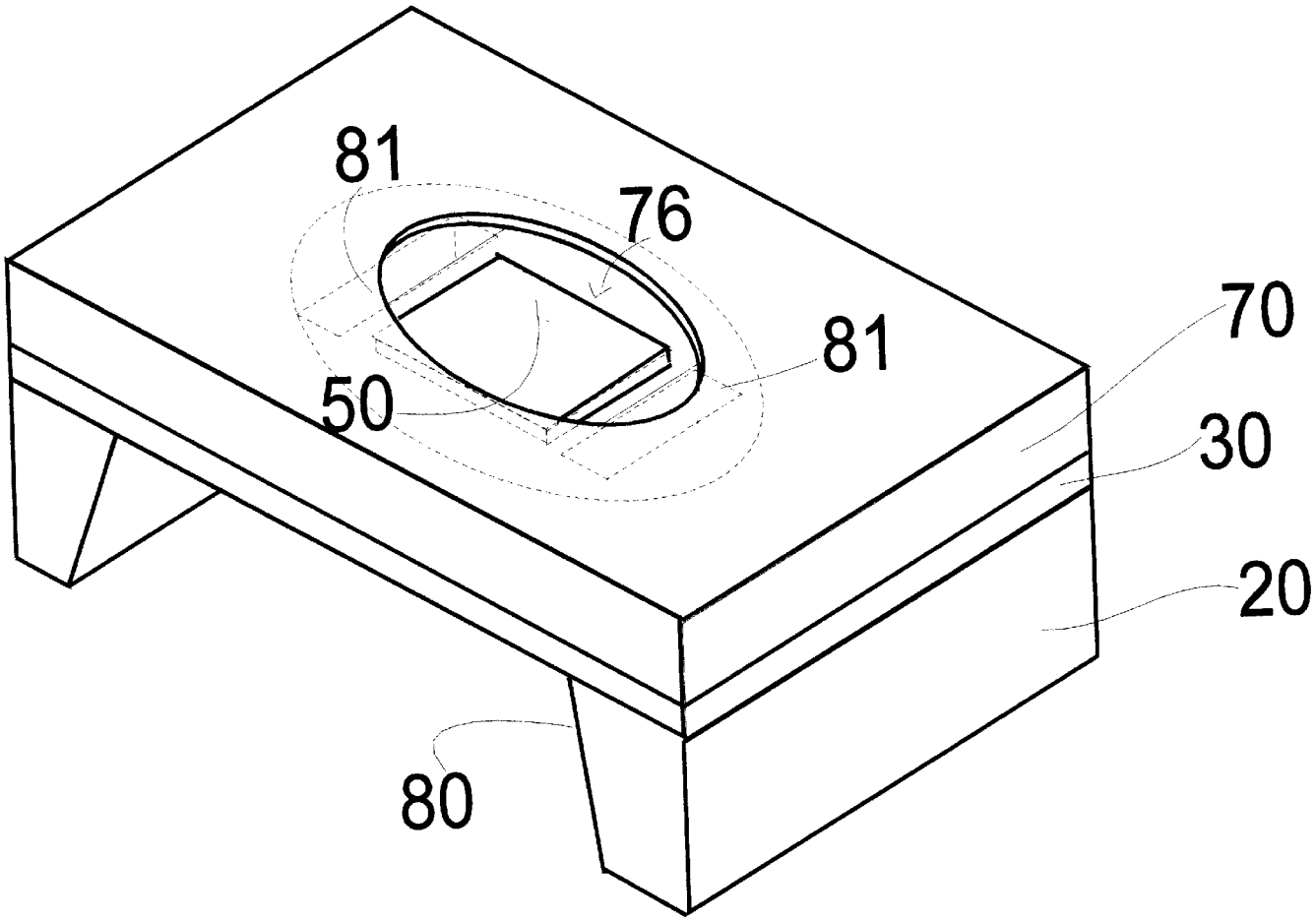
Fig. 1 --Prior Art--

HEAT SPREADER FOR INK-JET PRINTHEAD

FIELD OF THE INVENTION

This invention generally relates to inkjet printing. More particularly, this invention relates to the apparatus and the methods of making and using a printhead incorporating a heat spreader used to cool a resistor or other energy dissipation element that ejects ink from a fully integrated ink-jet printhead

BACKGROUND OF THE INVENTION

Ink-jet printing is a technology that uses small drops of fluid, such as ink, to form an image on a medium, such as paper, film, transparencies, and cloth to name a few. At least two types of ink-jet printing exist, continuous flow and drop-on-demand. Continuous flow ink-jet printing uses electrostatic acceleration and deflection to select ink drops from a constant flow of ink to form an image. Drop-on-demand inkjet printing has at least two forms, piezoelectric and thermal. Piezoelectric ink-jet printing uses a mechanical energy dissipation element to eject ink. Thermal ink-jet printing uses a resistive energy dissipation element to eject ink using heat energy. This heat energy vaporizes a thin layer of ink to form a bubble that ejects a small drop of ink through a nozzle. Forming a group of nozzles into an array on a substrate creates a printhead. As the ink leaves a nozzle in the printhead, the capillary action caused by the surface tension of the fluid within the nozzle pulls fresh ink back into the nozzle. This process is repeated thousands of times per second.

The physical components needed to implement thermal ink-jet technology are embodied in a print cartridge which contains the printhead, an ink supply and a pressure regulator for the ink supply. Different print cartridge body designs exist, each optimized to operate for a particular type of printing to be performed. Within the print cartridge is an ink delivery system used to provide pressure regulation and to supply ink from a container or reservoir to the printhead. Some examples of ink delivery systems are a rubber bladder, a foam block, a spring bag, and a bubble generator with an internal spring bag, to name a few. The printhead typically is formed by the application of thin or thick films onto a substrate. The substrate traditionally is a glass or silicon substrate but other suitable substrate materials are known to those skilled in the art.

Within the print cartridge is the container used to store the ink supply or a portion of a larger ink supply which may be stationary. The ink traditionally is either dye-based or pigment based. A dye-based ink typically provides the most vibrant colors and the widest color gamut. A pigment-based ink generally has enhanced water and light fastness, which enable outdoor signage and other applications. New applications for ink-jet printing require fluids other than ink. One such application is the layering of a protective coating over a previously recorded medium to increase the water or light fastness.

When ink is ejected from a printhead nozzle with a drop-on-demand system, it is typically done one drop at a time. An ejected drop of ink is characterized by its velocity, trajectory, volume, aerosols (stray spray), and tail. The ejected ink drop characteristics are correlative with the resulting image quality perceived by a user. Another aspect of the perceived quality is resolution of the ejected drops. As resolution increases, the volume of the ejected drops are typically reduced.

Further, when creating a higher resolution of an image at the same or comparable page print speed as now done for lower resolution images, the repetition rate of ejecting ink from the printhead increases. Increasing the repetition rate requires that more energy over time be applied to the energy dissipation elements in the printhead, thereby causing the printhead to become hotter due to residual heat. If the printhead becomes too hot, the drop of ink will not be ejected from the printhead with the desired velocity and trajectory. Further, the aerosols may become a large spray resulting in poor print quality or vapor lock may occur causing a misfire. Vapor lock is caused by a large bubble ejecting all ink from the nozzle (depriming the nozzle), thus not allowing the capillary action to draw more ink back into the nozzle. In addition, just as a fuse blows when it is overloaded, the energy dissipation elements may be damaged from the residual heat resulting in a printhead that no longer functions properly. This type of catastrophic failure is a great inconvenience to a user as the print cartridge has to be replaced.

To support the higher repetition rates, new efficient fluid paths have been developed. Some developments have resulted in energy dissipation elements that are suspended over the ink supply without backing from the substrate. In these developments, the substrate has an channel opening in which ink is conducted from the ink supply to the printhead nozzles. This substrate channel opening is where the energy dissipation elements are suspended. While this efficient path promotes quick refilling of the nozzle, thus allowing for increased repetition rates, residual heat left over in the energy dissipation elements after ejecting ink is unable to be properly dissipated into the substrate and ultimately into the ink supply. Further, as the density of the number of nozzles on a printhead increases to meet higher resolution goals, this residual heat is clustered into a more confined area than on conventional printheads. Some possible solutions have resulted in adding heat sinks to the printheads to help eliminate the residual heat. These approaches of adding a heat sink, nonetheless, increase the cost of the printhead.

However, due to increased competition from competitors and other technologies, the future of ink-jet printing lies in its versatility and its ability to continue to deliver high-quality color output at lower cost with higher reliability. Therefore a solution to the generation of residual heat must not only be low-cost, it must also support the need for increased reliability at even high density photographic quality color printing. A need thus exists to remove this excess residual heat as inexpensively as possible in order to meet a user's increased expectation of higher quality at a lower cost.

SUMMARY

A printhead for ejecting fluid has a nozzle on a first surface and a fluid feed channel defined within a second surface. The printhead includes an aggregate of thin-film layers, a portion of which is exposed by the fluid feed channel. The aggregate of thin-film layers contains at least one energy dissipation element suspended over the fluid feed channel. A heat spreader is mesially interposed within the aggregate of thin-film layers. The heat spreader proximally abuts to the energy dissipation element and extends from the energy dissipation element to extend past the fluid feed channel definition. The heat spreader is capable of dissipating heat from the energy dissipation element to a portion of the first surface of the printhead.

Further, the aggregate of thin-film layers within the printhead may have a plurality of fluid feed holes extending from the fluid feed channel to a nozzle applied on the thin-film layers. The plurality of fluid feed holes are arranged to allow the heat spreader to substantially abut the energy dissipation element while providing tolerance to blockage of the fluid feed holes caused by particles in the fluid.

BRIEF DESCRIPTION OF THE DRAWINGS

FIG. 1 illustrates an embodiment of a fully integrated thermal printhead.

DETAILED DESCRIPTION OF THE PREFERRED AND ALTERNATE EMBODIMENTS

Figure 2A:
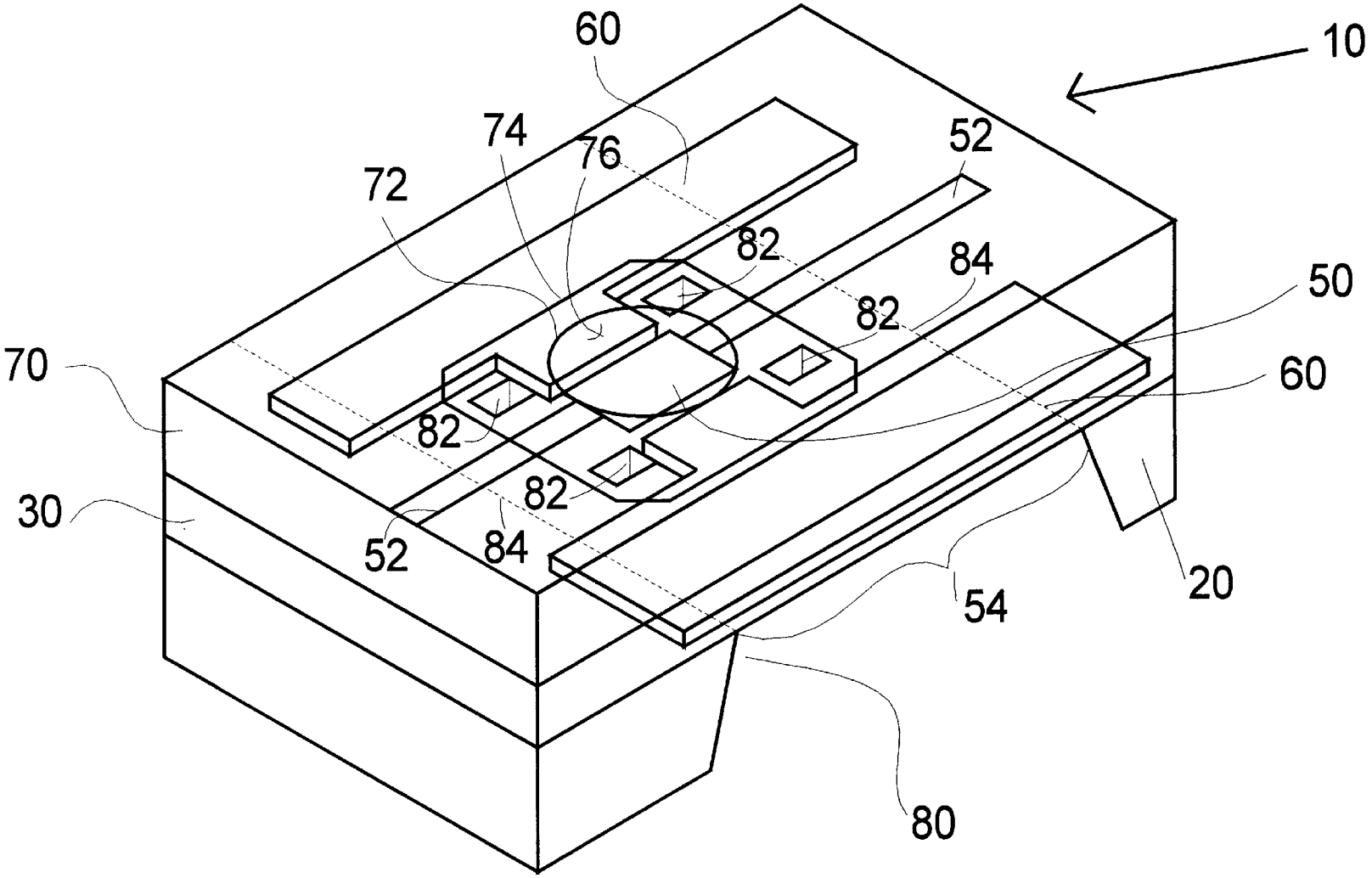
FIG. 2A is an isometric view of a portion of a printhead illustrating an embodiment of the invention in one nozzle of the printhead.

Several different architectures for manufacturing ink-jet printheads exist. However, the market driven forces of lower cost and higher quality have tended to facilitate the complete integration of the printhead into a monolithic device to create a Fully Integrated Thermal (FIT) Ink-jet architecture. As shown in FIG. 1, one embodiment of a FIT nozzle involves forming a trench or channel 80, such as by etching, through a substrate 20 up to the backside of an energy dissipation element (EDE) 50 which is used to eject a drop of fluid, such as ink, through a nozzle 76 formed in a nozzle layer 70. The etching of the substrate 20 creates a thin-film bridge 54 that allows fluid in the etched channel 80 to come into direct contact with a aggregate of thin-film layers 30 which are used to create the EDE 50. Earlier architectures for ink-jet printheads had resistors, or other EDE devices, built directly on a substrate allowing residual heat to escape rapidly into the substrate in-between successive nozzle drop ejection events. Since fluids such as ink, in general, are poor thermal conductors compared to substrates made of material such as silicon or other semiconductors, the FIT architecture of FIG. 1 does not have the benefit of a built-in heat sink. This lack of a built-in heat sink results in residual heat building up in the EDE 50 during successive drop ejection events. One problem with the build-up of the residual heat is that it causes the fluid that is refilling the nozzle 76 to boil uncontrollably. Thus fluid is ejected out of the nozzle 76 when it is not intended or vapor lock can occur where vapor bubbles deprime the pen nozzles. Another problem is that the elevated temperatures due to residual heat results in the EDE 50 having a shorter life, thus affecting the reliability of the printhead.

Although several methods have been suggested to add an additional heat sink to the thin-film bridge, many of these methods increase the manufacturing complexity and cost of a printhead. Since the channel for delivering fluid in a printhead with an array of nozzles is only a small portion of the bulk of the substrate 20, the substrate 20 is still available for use as a heat sink. Thermal modeling has shown that some of the heat transferred away from the EDE 50 is directed down metal leads attached to the EDE 50 in a direction roughly parallel to the channel 80, given the design depicted in FIG. 1. However, there is very little heat transfer away from the EDE 50 in the direction of the conventional fluid feed holes 81. One aspect of the invention is to remove, split, or displace at least one of the fluid feed holes to allow a heat spreader formed within the aggregate of thin-film layers to have access to the EDE 50 and to conduct the residual heat to a portion of substrate 20, which provides thermal coupling to the fluid supply. One embodiment is illustrated in FIG. 2, where the fluid feed holes from FIG. 1 have been each replaced with two fluid feed holes that are each proximate to a corner of the EDE 50. Then existing layers within the aggregate of thin-film layers 30 are used to create a heat spreader 60 (see FIG. 2) which proximately abuts the EDE 50 Abut meaning to lie adjacent or contiguous to another, e.g. border. The heat spreader 60 conducts residual heat away from the sides of the EDE 50 onto a wide area over the surrounding non-channeled substrate 20. By spreading the residual heat away from the EDE 50 into the substrate 20 over a wide area, the EDE 50 is able to operate properly for some applications without an attached heat sink. The heat spreader 60 may also be used with a FIT architecture which also includes a heat sink to further help in removing residual heat from the printhead by spreading the residual heat over a larger area. The heat spreader 60 is not connected to any electrically activated lines or the EDE 50. This reduces capacitive loading on the EDE 50 and also prevents an increase in turn-on energy which would be required to eject a drop of fluid from the nozzle opening 72. However, by having the heat spreader 60 proximately abut the EDE 50, residual heat can travel down the metal of the heat spreader 60 and over the thin-film bridge 54 out onto the substrate 20. This transferred residual heat then conducts vertically through the aggregate of thin-film layers 30 down to the substrate 20. By extending the heat spreader 60 over a wide area, the ability to conduct the residual heat from the substrate 20 into the surrounding fluid within the print cartridge is greatly enhanced.

FIG. 2A illustrates an exemplary single printhead nozzle 10 from a printhead 90 (see FIGS. 6A and 6B) which incorporates an embodiment of the heat spreader. A substrate 20, composed of silicon dioxide (glass), silicon, or other conventional semiconductors, forms a base which supports an aggregate of thin-film layers 30. The thin-film layers 30 are an aggregate of separate thin-film layers that can include conventional thermal ink-jet thin-film layers known to those skilled in the art with preferably at least one metal layer. The aggregate of thin-film layers 30 overlays one surface of the substrate 20. A nozzle layer 70 is disposed on the aggregate of thin-film layers 30. The nozzle layer 70 has a nozzle 76 that opens to the EDE 50. The nozzle 76 is preferably designed to shape and direct any fluid ejected from the printhead nozzle 10. Several methods for creating the nozzle layer 70 and nozzle 76 are known to those skilled in the art. On the backside of the printhead nozzle 10 is a fluid feed channel 80, formed within the substrate 20, that is used to couple fluid, such as ink, from a storage reservoir (not shown) to the printhead nozzle 10. The fluid feed channel 80 is directly opposite the substrate 20 to the EDE 50 creating a thin-film bridge 54. Optionally, the fluid feed channel 80 can be oriented 90 degrees to the direction shown and still meet the spirit and scope of the invention. The fluid is coupled to the nozzle 76 through a set of fluid feed holes 82. The nozzle 76 is made up of the nozzle opening 72 and nozzle base 74. A set of fluid feed holes 82 are openings defined within the aggregate of thin-film layers 30 that extend from the surface contacting the nozzle layer 70 to the fluid feed channel 80. The EDE 50 is attached electrically to leads 52 which deliver energy to the EDE 50. A heat spreader 60, preferably formed of one or more sections of metal, is positioned to lie adjacent to or proximately abut the EDE 50 as close as possible to conduct the residual heat away from the EDE 50. The actual separation of EDE 50 and the heat spreader 60 will typically be governed by thin-film design rules. The heat spreader 60 is formed mesially interposed within the aggregate of thin-film layers 30. Mesially interposed means that the heat spreader 60 is placed between and directed towards the midline of the aggregate of thin-film layers. The actual positioning depends on the thickness of various thin-films and the order in which the thin-films are applied in the aggregate. The heat spreader 60 then extends from the EDE 50 over the fluid feed channel 80 and past the plane 84 of the edge of the fluid feed channel 80 to cover a wide area over the substrate 20 where the transferred residual heat is released into the substrate 20. The heat spreader 60 is preferably formed from a pattern in one of the metal layers within the aggregate of thin-film layers 30. The metal layer may be aluminum, tantalum, aluminum-tantalum alloy, copper alloy, or a conventional thin-film metal, but preferably aluminum. Other metal layers are known to those skilled in the art and still would meet the scope and spirit of the invention. In the conventional FIT architecture of FIG. 1, the conventional fluid feed holes 81 are positioned adjacent and parallel to the sides of the EDE 50. These conventional fluid feed holes 81 limit the flow of residual heat away from the EDE 50. Another aspect of the invention is to increase the number of fluid feed holes 82 and locate them such that the heat spreader is allowed to substantially abut near the EDE 50 sides. In FIG. 2A, the fluid feed holes 82 are arranged such that each fluid feed hole 82 is diagonally opposite or diametrically spaced to each outer corner of the EDE 50. Diagonally means that that the holes are arranged in a diagonal direction. Diagonal meaning that the direction is at an angle connecting two non adjacent outer corners of EDE 50. Diametrically means as remote as possible as if at the opposite end of a diameter or directly adverse. Another benefit of implementing the fluid feed holes 82 in this manner is that tolerance to fluid blockage, due to particles in the fluid, is increased. In the traditional FIT architecture, if a conventional fluid feed hole 81 became blocked, one-half of the fluid flow into the nozzle 76 would be cut-off. With the four fluid feed hole 82 approach in FIG. 2A, if one fluid feed hole 82 becomes blocked, only one-fourth of the fluid flow into the nozzle 76 is cut-off.

Figure 2B:
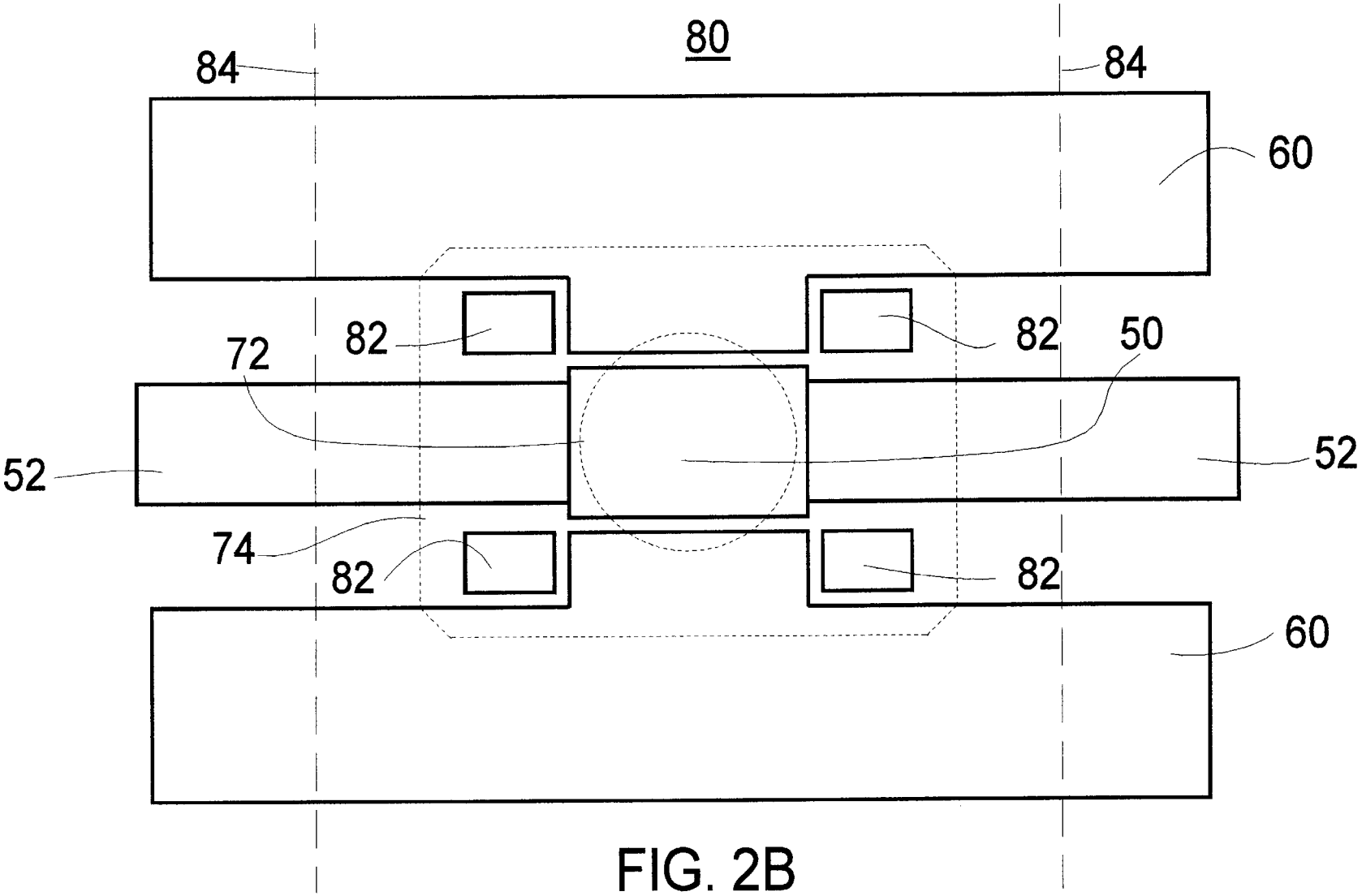
FIG. 2B is a top view of the nozzle in FIG. 2A.

FIG. 2B is a view of the exemplary embodiment of the printhead nozzle 10 illustrated in FIG. 2A from directly overhead. The dashed lines show the planes 84 extending from the edges of the fluid feed channel 84 through the aggregate of thin-film layers 30. The EDE 50 is connected to leads 52 and positioned within the nozzle base 74. Within the nozzle base 74 are the fluid feed holes 82 which are located diametrically to the corners of the EDE 50. The heat spreader 60 is shown consisting of two sections, each proximately abutting one side of the EDE 50 and extending over the fluid feed channel 80 and past the plane 84 of the fluid feed channel edges onto the substrate 20. The area of the heat spreader 60 over the substrate 20 must be made sufficient to allow the EDE 50 to operate properly at its designed specified repetition rate of ejecting fluid drops.

In FIG. 2B, the heat spreader 60 is shown extending along the direction of the fluid feed channel 80. Depending on the nozzle density on printhead 90 (see FIGS. 6A and 6B), this length may be limited without running into the heat spreader 60 of an adjacent nozzle. However, since all nozzles typically are not fired at the same time, it can be advantageous to combine the heat spreaders of separate nozzles to further increase the area in which residual heat is dissipated to the substrate 20.

Figures 3A, 3B, 3C:
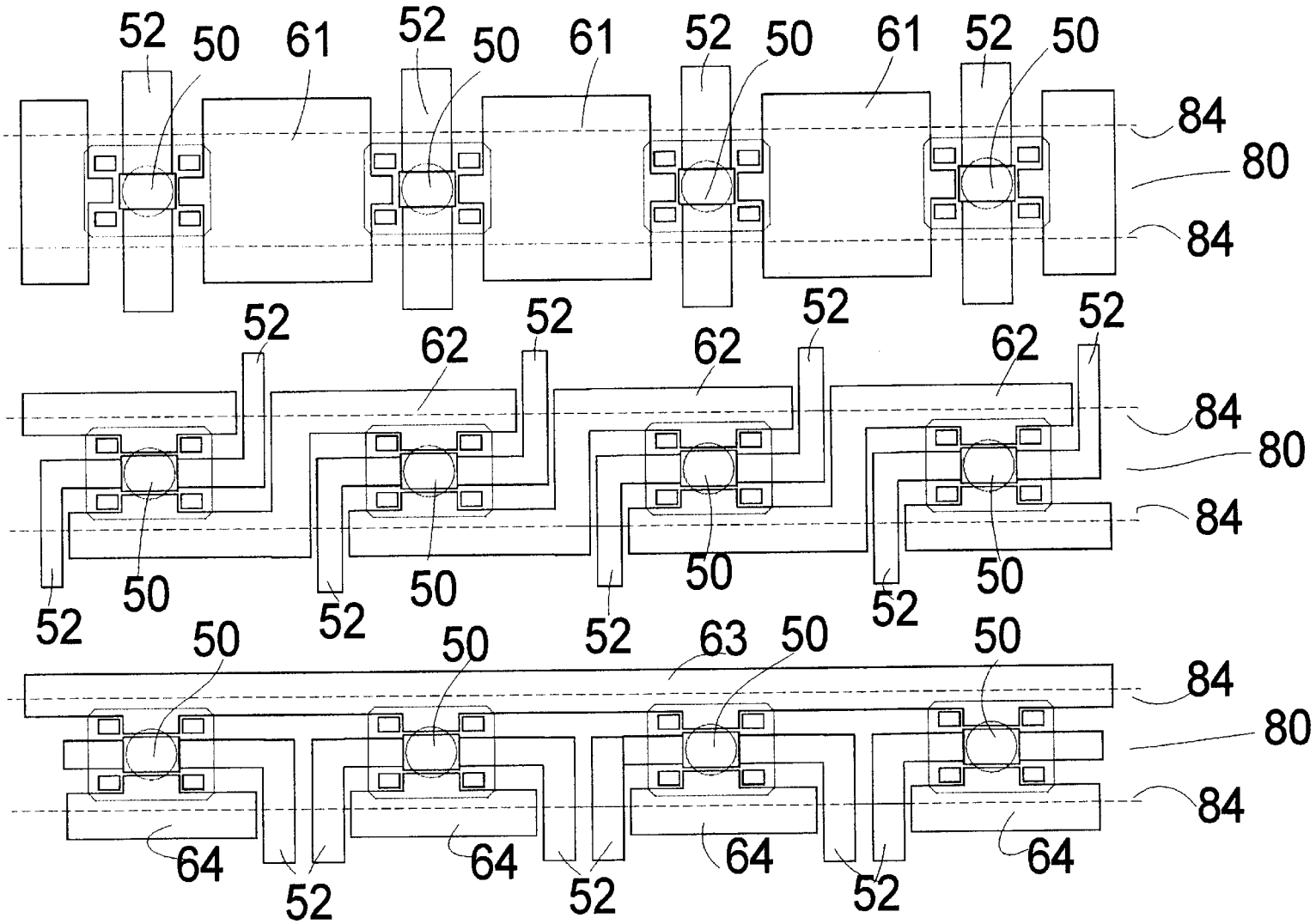
FIG. 3A is a first alternative embodiment of the invention wherein the heat spreader is joined to two nozzles.
FIG. 3B is a second alternative embodiment of the invention illustrating another layout for a heat spreader which is joined to two nozzles.
FIG. 3C is a third alternative embodiment of the invention illustrating sharing a portion of the heat spreader among more than two nozzles.

FIG. 3A illustrates a first alternative embodiment of the invention in which a first alternate heat spreader 61 proximately abuts and gathers heat from two adjacent nozzles and spreads the heat past the plane 84 of the edges of the fluid feed channel 80 out onto the substrate. The leads 52 are also designed to directly conduct heat away from the EDE 50 past the plane 84 of the fluid feed channel 80 edges and out onto the substrate.

FIG. 3B illustrates a second alternative embodiment of the invention in which a second alternate heat spreader 62 also performs the function of connecting the heat spreaders of two adjacent nozzles together. In this embodiment, the heat that is collected from each nozzle is spread over each side of the substrate opposite the planes 84 of the edges of the fluid feed channel 80.

FIG. 3C illustrates a third alternative embodiment of the invention in which a third alternative heat spreader 63 is proximately abutted to each EDE 50 along the fluid feed channel 80 and spreads the heat along a larger area of the substrate 20. Each nozzle also has a smaller single heat spreader 64 which further spreads heat from the EDE 50 out onto the substrate 20. One advantage of this embodiment is that heat is distributed to each nozzle, thereby tending to have each nozzle in thermal equilibrium with the others, which allows the formation of consistent drop volumes among nozzles. Those skilled in the art will appreciate that other layout patterns exist for the heat spreader and still meet the spirit and scope of the invention.

Figure 4C:
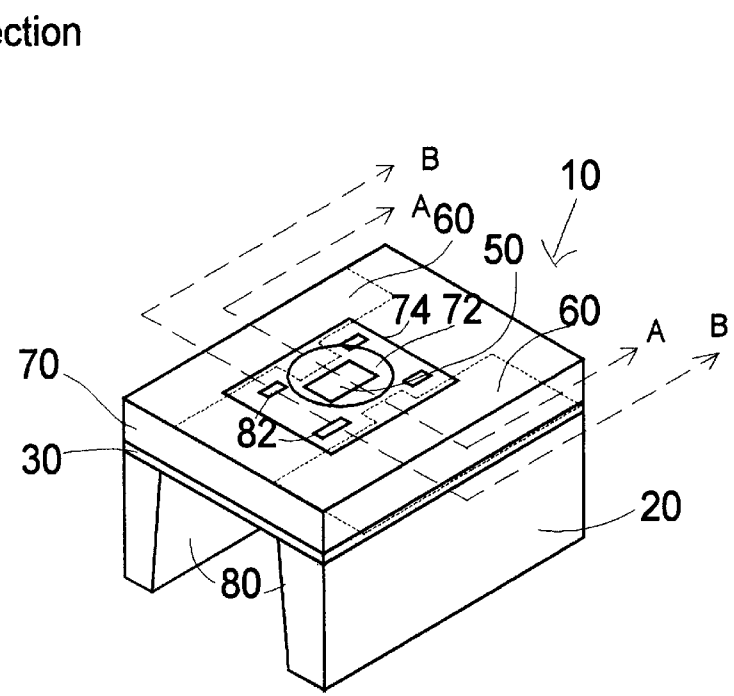
FIG. 4C is an isometric view of a nozzle from a printhead showing the cross-sections used to create the figures in FIG. 4B.
Figure 4B:
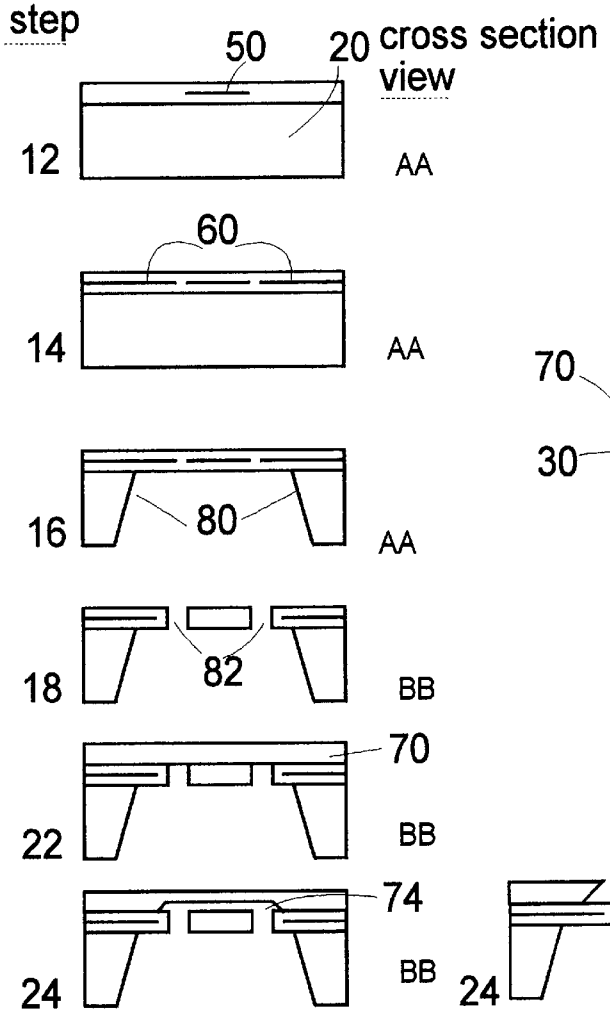
FIG. 4B shows multiple cross-sections of the printhead in FIG. 4C which illustrate the results of the process steps shown in FIG. 4A.
Figure 4A:
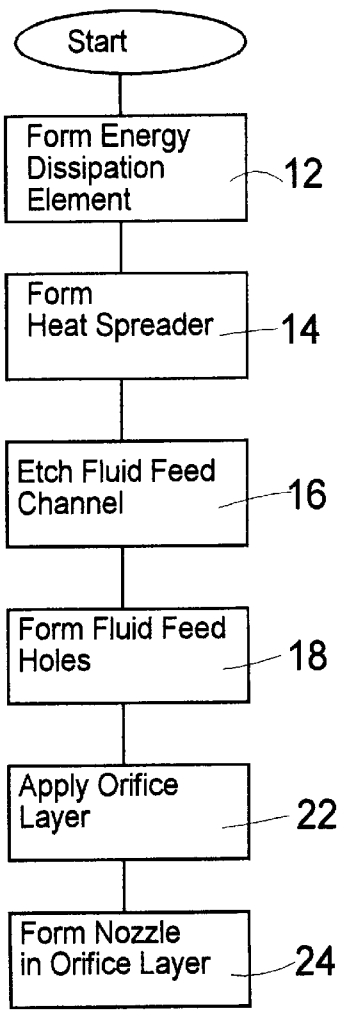
FIG. 4A is a flow chart of the process used to create a printhead incorporating the heat spreader.

FIGS. 4A, 4B, and 4C illustrate an exemplary process used to create the heat spreader and fluid feed holes of the invention. FIG. 4C is an isometric view of the printhead nozzle 10 showing the views used for cross-sections AA and BB shown in FIG. 4B. FIG. 4A is a flowchart showing the exemplary process steps used to create the printhead nozzle 10. FIG. 4B illustrates cross-sections of FIG. 4C which correspond to the results of the exemplary process steps shown in FIG. 4A. The process starts with a substrate 20 upon which an aggregate of thin-film layers 30 is applied or disposed upon. Within the process of applying the thin-film layers 30 an EDE 50 is formed. Also during the processing of the application of the thin-film layers 30 onto substrate 20 the heat spreader 60 is formed in one of the thermally conducting layers, preferably metal. The heat spreader 60 is patterned of one or more sections and formed to extend from proximately abutting the EDE 50 over and beyond where a fluid feed channel 80 will be formed within the substrate 20. The heat spreader 60 extends over the substrate 20 sufficient for residual heat to be conducted to the surface of the substrate 20.

After the aggregate thin-film layers 30 are disposed on the substrate 20, a fluid feed channel 80 is formed, preferably by etching, in the substrate 20. The fluid feed channel 80 is located opposite the EDE 50 formed in the aggregate of thin-film layers 30 such that the EDE 50 is suspended over the fluid feed channel 80. The process also includes a step of forming a plurality of fluid feed holes 82 within the aggregate of thin-film layers 30. The fluid feed holes 82 open into the fluid feed channel 80 and are positioned about the EDE 50 to allow the heat spreader 60 to proximately abut the EDE 50. A nozzle layer 70 is applied to the surface of the aggregate of thin-film layers 30 using one of several methods known to those skilled in the art. A nozzle opening 72 and a nozzle base 74 is formed in the nozzle layer 70. The nozzle encompasses the fluid feed holes 82 and the EDE 50. Although the process is shown as a sequence of steps, the order of the steps is not critical in defining the scope of the invention. Those skilled in the art will appreciate that the steps could be re-ordered and still meet the spirit and scope of the invention.

Figure 5:
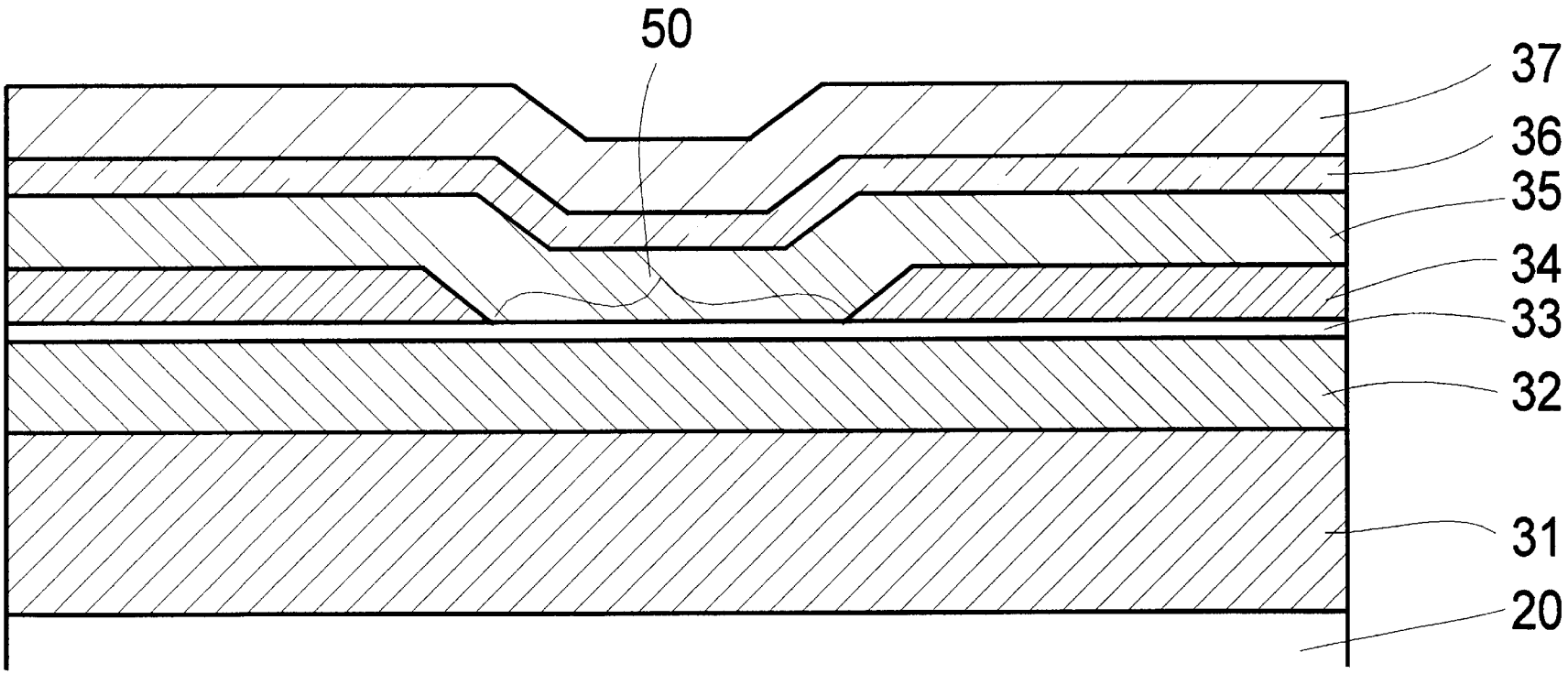
FIG. 5 is an exemplary embodiment of an aggregate of thin-film layers used to create the nozzle illustrated in FIG. 2A.

FIG. 5 is an exemplary embodiment of the aggregate of thin-film layers 30 which is used to implement the heat spreader 60 of the invention. Additional information on exemplary thin-film processes is found in "The Third-Generation HP Thermal Printhead" article in the February 1994 edition of the Hewlett-Packard Journal on pages 41–45. In this exemplary embodiment of FIG. 5, all of the thin-film layers can be applied using conventional processes known to those skilled in the art. A field oxide layer (FOX) 31 is first grown on the substrate 20 preferably with a thickness for this FOX 31 layer of approximately 1.2 $\mu$m. On the FOX layer 31 is applied a layer of CVD (chemical vapor deposited) $SiO_2$ 32 with a preferable thickness of approximately 0.5 $\mu$m. On top of the CVD $SiO_2$ 32 layer is placed a layer of Tantalum-Aluminum (TaAl) 33 with a preferable thickness of approximately 0.1 $\mu$m. A layer of Aluminum (Al) 34 with a preferable thickness of approximately 0.5 $\mu$m is applied and patterned on the TaAl 33 layer to form the EDE 50 and the heat spreader 60. To protect the Al 34 and TaAl 33 layers a passivation layer of Silicon Nitrate ($Si_3N_4$) 35 is applied with a preferable thickness of approximately 0.5 $\mu$m. Next, a layer of Silicon Carbide (SiC) 36 is applied on top of the $Si_3N_4$ 35 layer with a preferable thickness of approximately 0.25 $\mu$m to insulate the EDE 50 from the ink. Finally, for resistance to ink corrosion and to protect the EDE 50 from the aftershock of when the bubble that ejects the fluid drops collapses, a layer of Tantalum (Ta) 37 is applied on top of the SiC 36 layer to a preferable thickness of approximately 0.6 $\mu$m. Those skilled in the art will appreciate that other combinations and thickness' of thin-film layers exist to create the EDE 50 and heat spreader 60 and still meet the spirit and scope of the invention.

Several different options exist for dimensioning the printhead nozzle 10 shown in FIG. 2B. In one exemplary embodiment, the EDE 50 is sized at 20 $\mu$m×8 $\mu$m. The heat spreader 60 proximately abuts the EDE 50 within 3 $\mu$m along the 20 $\mu$m edge of EDE 50. The heat spreader 60 extends over the surface of the substrate 20 by 15 $\mu$m in each direction. The width of the fluid feed channel 80 is 70 $\mu$m. Thus, the length of the heat spreader 60 is 100 $\mu$m. In this embodiment, the nozzle base is approximately sized at 70 $\mu$m×35 $\mu$m. The nozzle opening is approximately sized at 12 $\mu$m.

Figures 6A, 6B:
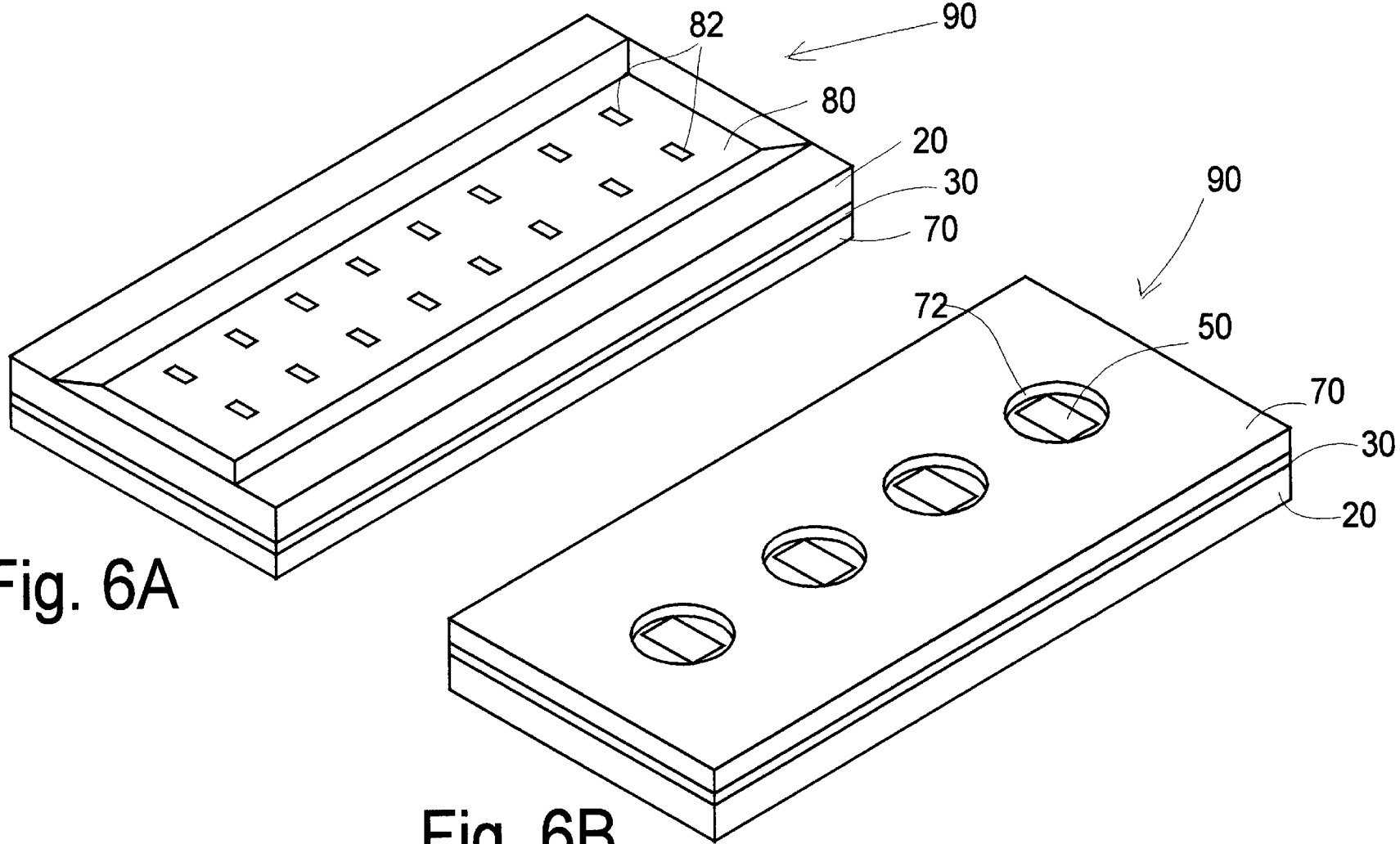
FIG. 6A is an isometric view of the back-side of an exemplary printhead which incorporates the heat spreader.
FIG. 6B is an isometric view of the front-side of the exemplary printhead shown in FIG. 6A.

FIG. 6A illustrates the backside of a printhead 90 which incorporates the heat spreader 60 (not shown) and fluid feed hole layout of the invention. The fluid feed channel 80 is formed in the substrate 20 to expose the aggregate layer of thin-film layers 30 and fluid feed holes 82.

FIG. 6B illustrates the front surface of the printhead 90 which has a plurality of nozzle openings 72, each exposing an EDE 50. The nozzle opening 72 is formed in the nozzle layer 70 which is applied on top of the aggregate of thin-film layers 30. Although only a limited number of nozzles are illustrated in FIGS. 6A and 6B for simplification, the number of nozzles in a printhead may reach into the hundreds or thousands and still meet the spirit and scope of the invention.

Figure 7:
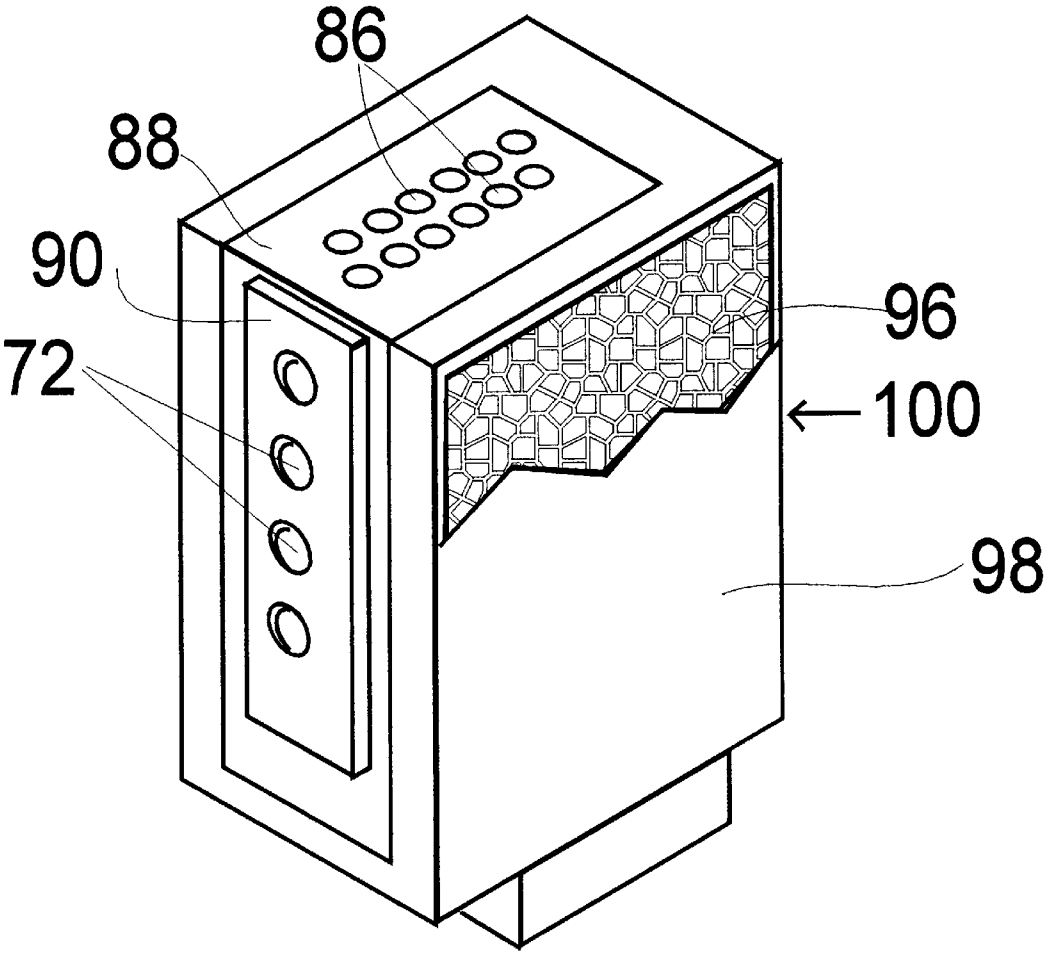
FIG. 7 illustrates an exemplary print cartridge which includes an exemplary printhead that incorporates the heat spreader.

FIG. 7 illustrates a fluid cartridge 100 for ejecting fluid onto a recording medium such a paper, film, vellum, cloth to name a few. The fluid cartridge 100 incorporates the printhead 90 which incorporates an embodiment of the heat spreader and fluid feed hole layout. The fluid cartridge 100 includes a container 98 for holding a fluid supply and a fluid delivery system 96 such as a sponge, spring bag, or rubber bladder to name a few. The printhead 90 is attached to a flex circuit 88 which electrically connects the printhead to contacts 86. The fluid cartridge 100 ejects fluid from the printhead 90 using an EDE 50 contained within a aggregate of thin-film layers 30 applied to a substrate 20. The EDE 50 may be a resistor, a piezoelectric device, or an electrostrictive element, preferably a resistor or other thermal energy dissipating element. The EDE 50 is suspended over an opening the fluid feed channel 80, in the substrate 20. The EDE 50 creates residual heat when ejecting fluid from the printhead 90. Within the printhead 90 is a heat spreader 60 which dissipates the residual heat from the EDE 50 onto the substrate 20 which is then further dissipated into the fluid supply. The heat spreader 60 is preferably formed of a metal layer or other thermally conductive layer within the aggregate of thin-film layers 30. The heat spreader 60 is mesially interposed within the aggregate of thin-film layers 30.

Note that fluid cartridge 100 can take on many forms while still utilizing the invention. For example, fluid cartridge 100 may be an integral, disposable print cartridge. Alternatively, fluid cartridge 100 may be of a semi-permanent variety that receives fluid from a separate fluid container. Such a separate fluid container may be coupled to fluid cartridge 100 directly or by way of a conduit such as a tube.

Figure 8:
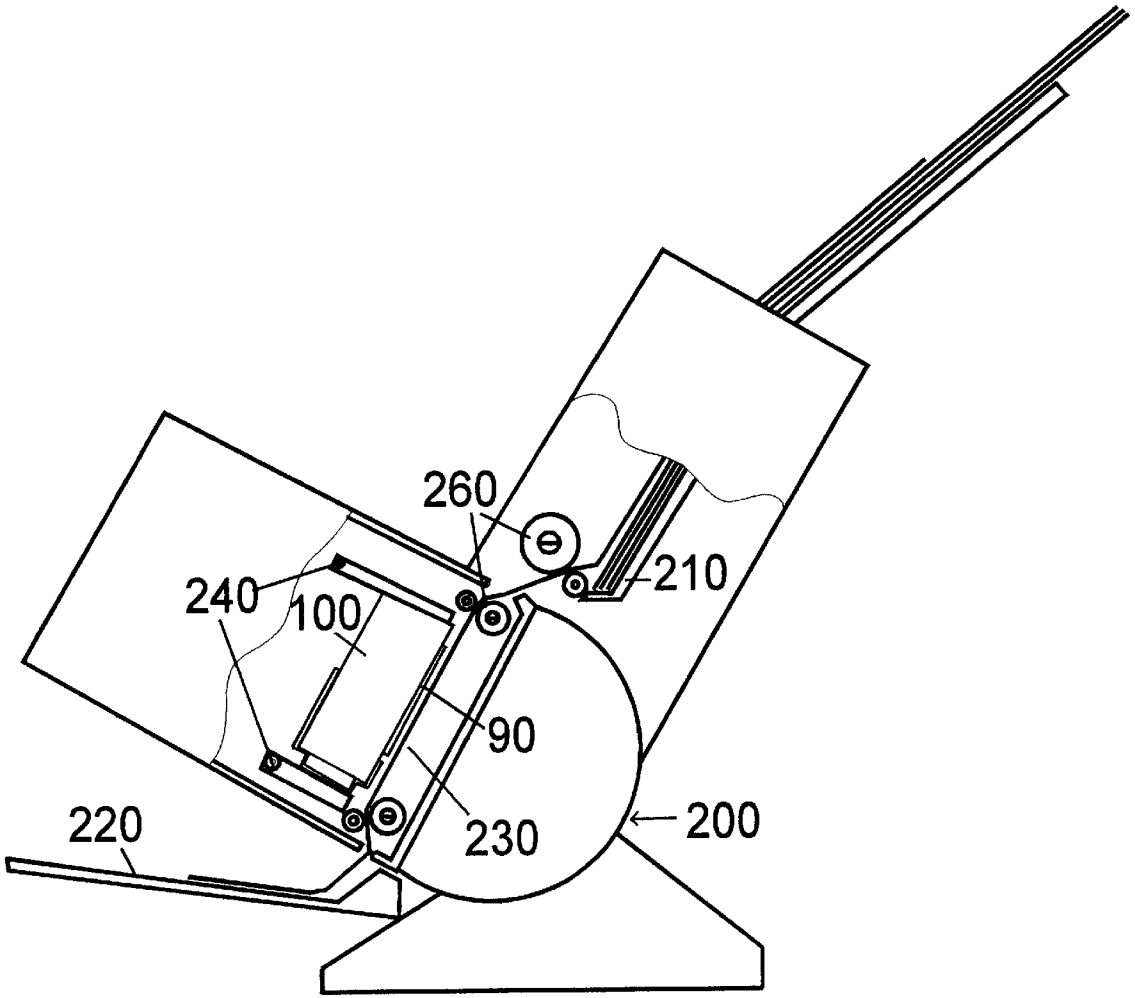
FIG. 8 is an exemplary recording apparatus which includes the exemplary print cartridge of FIG. 7.

FIG. 8 illustrates an exemplary printing apparatus 200 for placing fluid onto a medium such as paper. The printing apparatus 200 incorporates the printhead 90 which is conveyed along a carriage assembly 240 back and forth across a medium 230. The printing apparatus 200 includes a media tray 210 for storing multiple sheets of the medium 230. The medium 230 is transported from the media tray 210 to the printhead 90 of the fluid cartridge 100 and out to the exit tray 220 using a conveyance assemblage 260. During operation of the printing apparatus 200, residual heat in the printhead 90 that is generated by the ejection of fluid onto the medium is coupled to the substrate 20 (not shown) of the printhead 90 using a heat spreader 60 and further from the substrate 20 into the fluid supply.

Although the particular embodiment illustrated in FIG. 8 depicts a particular printing system, other printing systems may incorporate the invention, such as systems having fixed printheads with all relative motion between medium 230 and fluid cartridge 100 provided by a conveyance assemblage of the medium 230 such as in large format printing systems. Alternatively, some large format printing systems keep the media fixed and all relative motion between medium 230 and the fluid cartridge 100 is provided by a printhead conveyance assemblage. Other printing systems such as bar code printers would utilize a fixed fluid cartridge and only have a conveyance assemblage for the paper.

By incorporating a heat spreader within the aggregate thin-film layers no additional process steps beyond fabricating the FIT printhead are required. Modifying the arrangement of fluid feed holes increase the ability of the printhead nozzle to withstand particles in the fluid without causing a nozzle failure. The invention allows for increased printing resolution, increased repetition rate of drop ejection, and reduced product cost. All of the benefits are perceived by the user as an improvement in product quality.

What is claimed is:

1. A printhead for ejecting fluid having a first surface and a second surface, said first surface having at least one nozzle, said second surface having a fluid feed channel defined within, the printhead comprising:

an aggregate of thin-film layers, a portion of said aggregate of thin-film layers exposed by said fluid feed channel, said aggregate of thin-film layers including, at least one energy dissipation element suspended over said fluid feed channel, and a heat spreader mesially interposed within said aggregate of thin-film layers, said heat spreader proximately abutting said at least one energy dissipation element, said heat spreader extending from said at least one energy dissipation element to extending past the fluid feed channel definition wherein said heat spreader is not connected to said at least one energy dissipation element, and wherein said heat spreader is capable of dissipating heat from said at least one energy dissipation element over a portion of said first surface of the printhead.

2. The printhead of claim 1 further comprising an additional energy dissipation element wherein said heat spreader is capable of dissipating heat from said at least one energy dissipation element and said additional energy dissipation element over a portion of said first surface of the printhead.

3. The printhead of claim 1 wherein said aggregate of thin-film layers further comprises a layer of metal and wherein said heat spreader is comprised of a pattern in said metal layer.

4. The printhead of claim 3 wherein said layer of metal is selected from the group consisting of aluminum, tantalum, tantalum-aluminum alloy, and copper alloy.

5. The printhead of claim 1 wherein said heat spreader is comprised of a plurality of sections.

6. The printhead of claim 1 wherein said aggregate of thin-film layers further comprise a plurality of fluid feed holes extending from said fluid feed channel to said at least one nozzle and arranged to allow said heat spreader to substantially abut said at least one energy dissipation element.

7. The printhead of claim 6 wherein said at least one energy dissipation element has a shape comprising a plurality of corners and wherein said plurality of fluid feed holes are arranged such that one fluid feed hole is diagonally opposite to each corner of said at least one energy dissipation element thereby providing tolerance to blockage of fluid due to particles within the fluid.

8. A fluid cartridge for ejecting fluid onto a recording medium comprising the printhead of claim 1.

9. An apparatus for placing fluid onto a medium comprising the printhead of claim 1.

10. A printhead for ejecting fluid, the printhead comprising:

is a substrate having a first surface, a second surface, and a fluid feed channel defined within said second surface of said substrate;

an aggregate of thin-film layers applied to said first surface of said substrate, the aggregate of thin-film layers including, a metal thin-film layer, at least one energy dissipation element suspended over said fluid feed channel, said at least one energy dissipation element capable of generating heat, and a heat spreader defined within said metal thin-film layer, said heat spreader proximately abutting said at least one energy dissipation element and extending past said fluid feed channel definition wherein said heat spreader is not connected to said at least one energy dissipation element, and wherein said heat spreader is capable of conducting heat from said at least one energy dissipation element to said first surface of said substrate; and a nozzle layer disposed on said aggregate of thin-film layers, said nozzle layer having at least one nozzle opening to said at least one energy dissipation element.

11. The printhead of claim 10, wherein said at least one energy dissipation element has a plurality of corners, the printhead further comprising a plurality of fluid feed holes defined within said aggregate of thin-film layers and disposed over said fluid feed channel and opening into said at least one nozzle, said fluid feed holes spaced diametrically to said plurality of corners of said at least one energy dissipation element thereby allowing said heat spreader to proximately abut said at least one energy dissipation element.

12. The printhead of claim 11 wherein said plurality of fluid feed holes are arranged to allow said plurality of fluid feed holes to be capable of providing tolerance to blockage of fluid from said fluid feed channel to said nozzle in said nozzle layer due to at least one particle within the fluid.

13. A fluid cartridge for ejecting fluid onto a recording medium comprising the printhead of claim 10.

14. An apparatus for placing fluid onto a medium comprising the printhead of claim 10.

15. A printhead for ejecting fluid, comprising:

a substrate having a first surface, a second surface, and a fluid feed channel defined within said second surface;

an aggregate of thin-film layers disposed upon said first surface of said substrate;

means for generating energy within said aggregate of thin-film layers to eject the fluid, said means for generating energy also creating excess heat;

means for dissipating said excess heat to said first surface of said substrate, said means for dissipating mesially interposed within said aggregate of thin-film layers wherein said means for dissipating is not connected to said means for generating energy; and means for shaping and directing said ejected fluid disposed on said aggregate of thin-film layers.

16. The printhead of claim 15 further comprising means for coupling fluid from said fluid feed channel to said means for shaping and directing wherein said means for coupling fluid is resistant to blockage due to particles within said fluid.

17. A fluid cartridge for ejecting fluid onto a recording medium comprising the printhead of claim 15.

18. An apparatus for placing fluid onto a medium comprising the printhead of claim 15.

19. A method for creating a printhead, the method comprising the steps of:

forming at least one energy dissipation element within an aggregate of thin-film layers disposed on a first surface of a substrate;

forming a fluid feed channel on a second surface of said substrate, said fluid feed channel opposite said at least one energy dissipation element; and forming a heat spreader within said aggregate of thin-film layers, said heat spreader extending from proximate to said at least one energy dissipation element to extending past said fluid feed channel over said first surface of said substrate sufficient for heat to be capable of conducting to said first surface of said substrate wherein said heat spreader is not connected to said at least one energy dissipation element.

20. A printhead produced in accordance the method of claim 19.

21. An apparatus for placing fluid onto a medium comprising the printhead of claim 20.

22. The method in accordance with claim 19, further comprising the steps of:

forming a plurality of fluid feed holes within said aggregate of thin-film layers said plurality of fluid feed holes opening into said fluid feed channel and said plurality of fluid feed holes positioned about said at least one energy dissipation element to allow said heat spreader to be proximate to said at least one energy dissipation element;

applying a nozzle layer on said aggregate of thin-film layers; and forming at least one nozzle within said nozzle layer, said at least one nozzle encompassing said plurality of fluid feed holes and said at least one energy dissipation element.

23. A printhead produced in accordance the method of claim 22.

24. A fluid cartridge for ejecting fluid onto a recording medium comprising the printhead of claim 23.

25. A fluid cartridge for ejecting fluid onto a recording medium, the fluid cartridge comprising:

a printhead for ejecting fluid including, a substrate having a first surface, a second surface, and a fluid feed channel defined within said second surface, an aggregate of thin-film layers disposed upon said first surface of said substrate, means for generating energy within said aggregate of thin-film layers to eject the fluid, said means for generating energy also creating excess heat, means for dissipating said excess heat to said first surface of said substrate, said means for dissipating mesially interposed within said aggregate of thin-film layers wherein said means for dissipating is not connected to said means for generating energy, and means for shaping and directing said ejected fluid disposed on said aggregate of thin-film layers;

a container for holding a quantity of fluid; and a fluid delivery assemblage wherein the conveyance of said quantity of fluid from said container to said fluid channel of said printhead is regulated.

26. An apparatus for placing fluid onto a medium, the apparatus comprising:

a fluid cartridge for ejecting fluid onto a recording medium, the fluid cartridge including, a printhead for ejecting fluid including, a substrate having a first surface, a second surface, and a fluid feed channel defined within said second surface, an aggregate of thin-film layers disposed upon said first surface of said substrate, means for generating energy within said aggregate of thin-film layers to eject the fluid, said means for generating energy also creating excess heat, means for dissipating said excess heat to said first surface of said substrate, said means for dissipating mesially interposed within said aggregate of thin-film layers wherein said means for dissipating is not connected to said means for generating energy, and means for shaping and directing said ejected fluid disposed on said aggregate of thin-film layers, a container for holding a quantity of fluid, and a fluid delivery assemblage wherein the conveyance of said quantity of fluid from said container to said fluid channel of said printhead is regulated; and a conveyance assemblage for transporting said medium on which recording is effected by said fluid cartridge.

27. A method for cooling a printhead which ejects fluid, the printhead having a substrate and an energy dissipation element contained within a aggregate of thin-film layers applied to the substrate, the energy dissipation element suspended over an opening in the substrate, the energy dissipation element creating residual heat when ejecting fluid, the method comprising the step of transferring the residual heat from the energy dissipation element from over the opening in the substrate into the substrate where there is no opening using a heat spreader mesially interposed within said aggregate of thin-film layers wherein said heat spreader is not connected to said at least one energy dissipation element.

28. A method for operating a fluid cartridge for ejecting fluid onto a recording medium, the fluid cartridge having a printhead and a container holding a fluid supply, the method comprising the steps of:

ejecting fluid from the printhead using an energy dissipation element contained within a aggregate of thin-film layers applied to a substrate, the energy dissipation element suspended over an opening in the substrate, the energy dissipation element creating residual heat when ejecting fluid;

transferring the residual heat from the energy dissipation element from over the opening in the substrate into the substrate where there is no opening using a heat spreader mesially interposed within said aggregate of thin-film layers wherein said heat spreader is not connected to said at least one energy dissipation element; and dissipating the transferred residual heat into the fluid supply of the fluid cartridge.

29. A method for operating an apparatus for placing fluid onto a medium comprising the method for operating a fluid cartridge of claim 27.

* * * * *